US008052343B2

(12) United States Patent
Zhang et al.

(10) Patent No.: US 8,052,343 B2
(45) Date of Patent: Nov. 8, 2011

(54) RING BINDER MECHANISM

(75) Inventors: Ze Yu Zhang, NeiJiang (CN); Wing Yiu Ng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 0 days.

(21) Appl. No.: 12/502,657

(22) Filed: Jul. 14, 2009

(65) Prior Publication Data

US 2009/0274508 A1 Nov. 5, 2009

Related U.S. Application Data

(63) Continuation of application No. 11/610,358, filed on Dec. 13, 2006, now Pat. No. 7,648,302.

(60) Provisional application No. 60/827,205, filed on Sep. 27, 2006.

(51) Int. Cl.
*B42F 13/00* (2006.01)
*B42F 13/20* (2006.01)

(52) U.S. Cl. ..... 402/31; 402/26; 402/35; 402/36; 402/38; 402/502

(58) Field of Classification Search ..... 281/15.1, 281/27.1, 29, 51; 283/63.1, 64, 117; 402/2, 402/26, 31, 35, 36, 38, 41, 44, 46, 70, 73, 402/80 R, 80 P, 502
See application file for complete search history.

(56) References Cited

U.S. PATENT DOCUMENTS 0,566,717 A 8/1896 Krah
0,651,254 A 6/1900 Krah
0,683,019 A 9/1901 Buchanan
0,790,382 A 5/1905 McBride
0,854,074 A 5/1907 Bryant
0,857,377 A 6/1907 Baker
0,974,831 A 11/1910 Scherzinger
1,011,391 A 12/1911 Sturgis (Continued)

FOREIGN PATENT DOCUMENTS

EP 1431065 A2 6/2004

(Continued)

OTHER PUBLICATIONS

Kokuyo Lock Ring Mechanism with description, two instruction sheets, and nine photographs, undated but admitted as prior art, 12 pgs.

(Continued)

*Primary Examiner* — Dana Ross
*Assistant Examiner* — Justin Lewis
(74) *Attorney, Agent, or Firm* — Senniger Powers LLP

(57) ABSTRACT

A ring mechanism for retaining loose-leaf pages including a housing, hinge plates, and ring members mounted on the hinge plates for retaining pages on the mechanism. An actuating lever is pivotally mounted on the housing for engaging the hinge plates and pivoting them to selectively move the ring members between an open position and a closed position. A travel bar is operatively connected to the lever for selective movement between a position in which locking elements of the travel bar block the pivoting movement of the hinge plates and a position in which the travel bar allows the hinge plates to pivot. The lever is configured to deform when pivoting the hinge plates to close the ring members to delay movement of the travel bar and locking elements to the blocking position from the onset of pivoting motion of the hinge plates.

28 Claims, 13 Drawing Sheets

U.S. PATENT DOCUMENTS

| | | | |
|---|---|---|---|
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,733,548 | A | 10/1929 | Martin |
| 1,733,894 | A | 10/1929 | Martin |
| 1,787,957 | A | 1/1931 | Schade |
| 1,822,669 | A | 9/1931 | Schade |
| 1,857,291 | A | 5/1932 | Trussell |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis et al. |
| 2,251,878 | A | 8/1941 | Hanna et al. |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil, Sr. |
| 2,552,076 | A | 5/1951 | Wedge |
| 2,612,169 | A | 9/1952 | Segal |
| 2,789,561 | A | 4/1957 | Bonn et al. |
| 2,865,377 | A | 12/1958 | Schroer et al. |
| 2,871,711 | A | 2/1959 | Stark |
| 2,891,553 | A | 6/1959 | Acton |
| 2,894,513 | A | 7/1959 | Gempe et al. |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,352,582 | A | 10/1982 | Eliasson |
| 4,486,112 | A | 12/1984 | Cummins |
| 4,522,526 | A | 6/1985 | Lozfau et al. |
| 4,566,817 | A | 1/1986 | Barrett, Jr. |
| 4,571,108 | A | 2/1986 | Vogl |
| 4,696,595 | A | 9/1987 | Pinkney |
| 4,798,491 | A | 1/1989 | Lassle |
| 4,813,803 | A | 3/1989 | Gross |
| 4,815,882 | A | 3/1989 | Ohminato |
| 4,886,390 | A | 12/1989 | Silence et al. |
| 4,919,557 | A | 4/1990 | Podosek |
| 5,067,840 | A | 11/1991 | Cooper et al. |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,524,997 | A | 6/1996 | von Rohrscheidt |
| 5,577,852 | A | 11/1996 | To |
| 5,651,628 | A | 7/1997 | Bankes et al. |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,924,811 | A | 7/1999 | To et al. |
| 5,957,611 | A | 9/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To et al. |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder et al. |
| 6,293,722 | B1 | 9/2001 | Holbrook et al. |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,223,040 | B2 | 5/2007 | Koike et al. |
| 7,275,886 | B2 | 10/2007 | Cheng |
| 7,296,946 | B2 | 11/2007 | Cheng et al. |
| 7,404,685 | B2 | 7/2008 | Cheng |
| 7,478,963 | B2 | 1/2009 | Tanaka et al. |
| 7,524,128 | B2 | 4/2009 | Cheng |
| 7,534,064 | B2 | 5/2009 | Cheng |
| 7,549,817 | B2 | 6/2009 | Cheng et al. |
| 2003/0044221 | A1 | 3/2003 | To et al. |
| 2005/0201817 | A1 | 9/2005 | Cheng |
| 2005/0201818 | A1 | 9/2005 | Cheng |
| 2005/0207826 | A1 | 9/2005 | Cheng et al. |
| 2005/0214064 | A1 | 9/2005 | Ng et al. |
| 2006/0008318 | A1 | 1/2006 | Ng |
| 2006/0056906 | A1 | 3/2006 | Horn |
| 2006/0088365 | A1 | 4/2006 | Whaley |
| 2006/0147254 | A1 | 7/2006 | Cheng |
| 2006/0153629 | A1* | 7/2006 | Cheng ..... 402/38 |
| 2006/0216107 | A1 | 9/2006 | Lin |
| 2006/0228164 | A1 | 10/2006 | Horn |
| 2006/0251467 | A1 | 11/2006 | Cheng |
| 2006/0251468 | A1 | 11/2006 | Cheng |
| 2007/0086836 | A1 | 4/2007 | Cheng |
| 2007/0160415 | A1 | 7/2007 | To et al. |
| 2008/0075526 | A1 | 3/2008 | Ng et al. |
| 2008/0075527 | A1 | 3/2008 | Pi et al. |

FOREIGN PATENT DOCUMENTS

| | | | |
|---|---|---|---|
| FR | 1336765 | | 9/1963 |
| FR | 1346864 | | 12/1963 |
| FR | 2221924 | | 10/1974 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2275023 | A | 8/1994 |
| GB | 2292343 | A | 2/1996 |
| GB | 2387815 | A | 10/2003 |
| JP | 5979379 | | 5/1984 |
| JP | 6118880 | | 2/1986 |
| JP | 62189178 | U | 12/1987 |
| JP | 1299095 | A1 | 12/1989 |
| JP | 2034289 | U | 3/1990 |
| JP | 4120085 | | 10/1992 |
| JP | 10217662 | | 8/1998 |
| JP | 2004098417 | A | 4/2004 |

OTHER PUBLICATIONS

European search report issued May 6, 2009 from related application EP 07 11 2561, 5 pgs.

European Search Report dated May 15, 2009 regarding related application EP07112563, 8 pgs.

European Search Report dated May 18, 2009 regarding related application EP07112577, 7 pgs.

Office action issued Jun. 26, 2009 in related U.S. Appl. No. 11/681,590, 11 pgs.

Response filed Oct. 21, 2009 to Office Action dated Jun. 26, 2009 from related U.S. Appl. No. 11/681,590, 20 pgs.

Office action issued Mar. 12, 2010 in related U.S. Appl. No. 11/697,556, 10 pgs.

Response filed Jun. 29, 2010 to Office Action dated Mar. 12, 2010 from related U.S. Appl. No. 11/697,556, 18 pgs.

* cited by examiner

RING BINDER MECHANISM

CROSS-REFERENCE TO RELATED APPLICATIONS

This application is a continuation of U.S. Non-Provisional application Ser. No. 11/610,358, filed Dec. 12, 2006 which claims the benefit of U.S. Provisional Application No. 60/827,205, filed Sep. 27, 2006, which is hereby incorporated by reference in its entirety.

BACKGROUND OF THE INVENTION

This invention relates to a ring binder mechanism for retaining loose-leaf pages, and in particular to an improved ring binder mechanism for opening and closing ring members and for locking closed ring members together.

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis. An elongate housing loosely supports the hinge plates within the housing and holds the hinge plates together so they may pivot relative to the housing.

The undeformed housing is slightly narrower than the joined hinge plates when the hinge plates are in a coplanar position (180°). So as the hinge plates pivot through this position, they deform the resilient housing and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. Levers may also be provided on one or both ends of the housing for moving the ring members between the open and closed positions. But a drawback to these known ring binder mechanisms is that when the ring members are closed, they do not positively lock together. So if the mechanism is accidentally dropped, the ring members may unintentionally open.

Some ring binder mechanisms have been modified to include locking structure to block the hinge plates from pivoting when the ring members are closed. The blocking structure positively locks the closed ring members together, preventing them from unintentionally opening if the ring mechanism is accidentally dropped. The blocking structure also allows the housing spring force to be reduced because the strong spring force is not required to clamp the closed ring members together. Thus, less operator force is required to open and close the ring members of these mechanisms than in traditional ring mechanisms.

Some of these ring mechanisms incorporate the locking structure onto a control slide connected to the lever. The lever moves the control slide (and its locking structure) to either block the pivoting movement of the hinge plates or allow it. But a drawback to these mechanisms is that an operator must positively move the lever after closing the ring members to position the locking structure to block the hinge plates and lock the ring members closed. Failure to do this could allow the hinge plates to inadvertently pivot and open the ring members, especially if the mechanisms are accidentally dropped.

Some locking ring binder mechanisms use springs to move the locking structure into position blocking the hinge plates when the ring members close. Examples are shown in co-assigned U.S. patent application Ser. No. 10/870,801 (Cheng et al.), Ser. No. 10/905,606 (Cheng), and Ser. No. 11/027,550 (Cheng). These mechanisms employ separate springs to help lock the mechanisms.

Movement of the locking structure is generally linear or translational, but the actuator is moved by pivoting a lever. Accordingly, there is a need to transfer only the translational component of the lever's motion to the locking structure. There are solutions that have been proposed. For example, refer to co-owned U.S. patent application Ser. No. 10/870,801. However, there is a need to accomplish the transmission of motion with structure which is inexpensive to manufacture, simple in overall construction, and reliable in repeated operation.

SUMMARY OF THE INVENTION

A ring mechanism for holding loose-leaf pages generally comprises a housing and rings for holding the loose-leaf pages. Each ring includes a first ring member and a second ring member. The first ring members are movable relative to the housing and the second ring members between a closed position and an open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. An actuation system of the mechanism comprises first and second hinge plates supported by the housing for pivoting motion relative to the housing, and an actuator mounted on the housing for movement relative to the housing to cause the pivoting motion of the hinge plates. The first ring members are mounted on the first hinge plate for movement between the closed and open positions. The actuator is moveable between a first position in which the ring members are closed and a second position in which the ring members are open. A locking system is moveable by the actuator between a locked position in which the ring members are held in the closed position and an unlocked position in which the ring members can move from the closed position to the open position. The actuation system is adapted to deform upon movement of the actuator from the second position to the first position to delay the movement of the locking system from the pivoting motion of the hinge plates.

In another aspect, the ring mechanism comprises a housing and hinge plates supported by the housing for pivoting motion relative to the housing. Rings hold loose-leaf pages on the mechanism. Each ring includes a first ring member and a second ring member. The first ring member is mounted on a first of the hinge plates for movement with the hinge plate relative to the second ring member between a closed position and an open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. The mechanism also comprises an actuator mounted on the housing for movement relative to the housing to cause the pivoting motion of the hinge plates. The actuator comprises a flexible first portion and a body. A locking element releasably locks the closed ring members in a locked position and releases the closed ring members to move to the open position in an unlocked position. The locking element is operatively connected to the actuator at the first portion of the actuator for conjoint translational movement with the first portion. The first portion of the actuator is adapted to flex relative to the body of the actuator during operation of the actuator to close the ring members.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
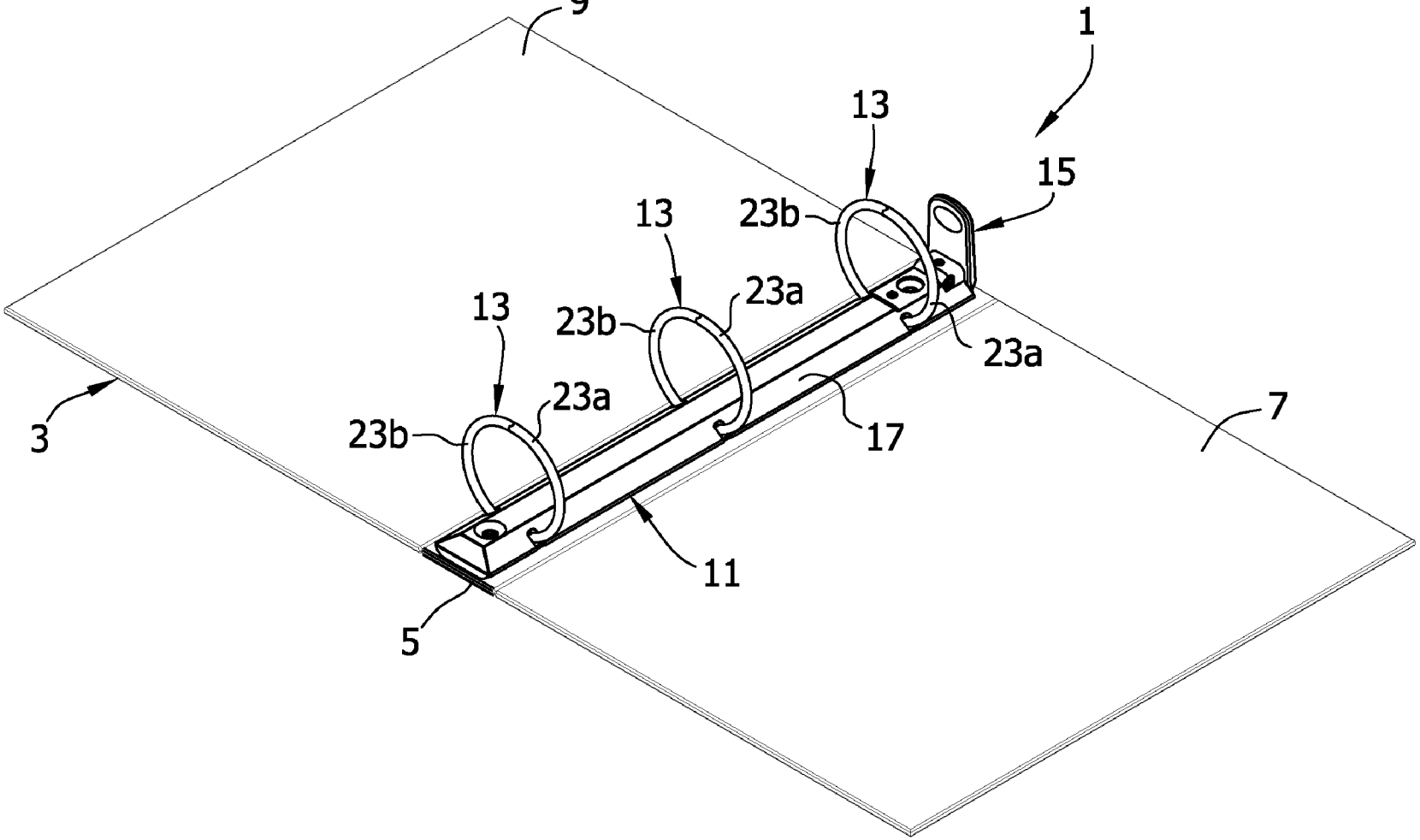
FIG. 1 is a perspective of a notebook incorporating a ring binder mechanism of the invention.

Referring to the drawings, FIGS. 1-13 show a ring binder mechanism of the invention generally at 1. In FIG. 1, the mechanism 1 is shown mounted on a notebook designated generally at 3. Specifically, the mechanism 1 is shown mounted on a spine 5 of the notebook 3 between a front cover 7 and a back cover 9 hingedly attached to the spine 3. The front and back covers 7, 9 move to selectively cover or expose loose-leaf pages (not shown) retained by the mechanism 1 in the notebook 3. Ring binder mechanisms mounted on notebooks in other ways or on surfaces other than a notebook, for example, a file, do not depart from the scope of this invention.

Figure 2:
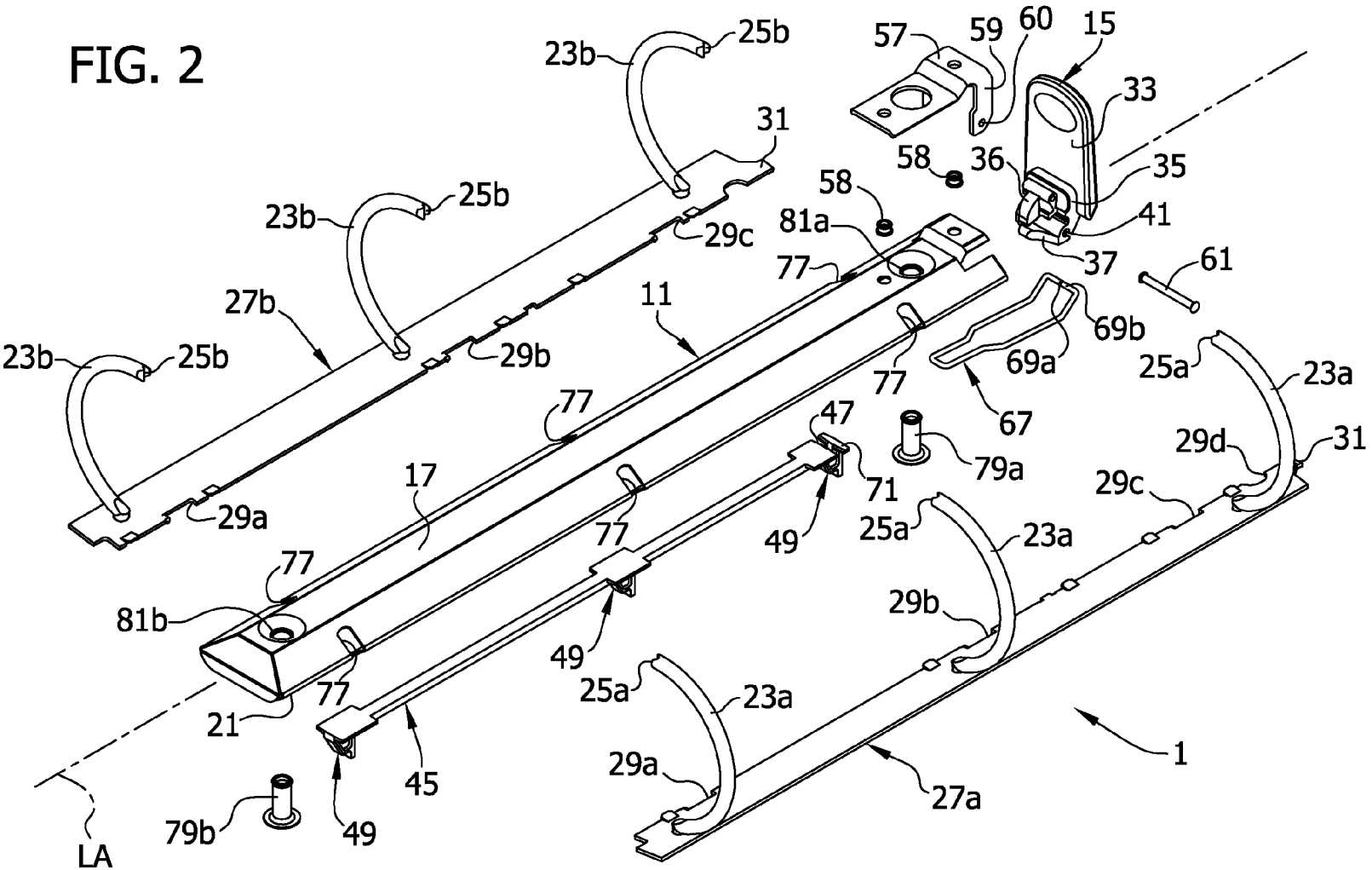
FIG. 2 is an exploded perspective of the ring mechanism.

As shown in FIG. 1, a housing, designated generally at 11, supports three rings (each designated generally at 13) and a lever (broadly, "actuator," and designated generally at 15). The rings 13 retain loose-leaf pages on the ring mechanism 1 in the notebook 3 while the lever 15 operates to open and close the rings so that pages may be added or removed. Referring now also to FIG. 2, the housing 11 is shaped as an elongated rectangle with a uniform, roughly arch-shaped cross section, having at its center a generally flat plateau 17. A first longitudinal end of the housing 11 (to the right in FIG. 2) is generally open while a second, opposite longitudinal end is generally closed. Bent under rims, each designated at 21 (FIGS. 2 and 5), extend lengthwise along longitudinal edges of the housing 11 from the first longitudinal end of the housing to the second longitudinal end. Mechanisms having housings of other shapes, including irregular shapes, or housings that are integral with a file or notebook do not depart from the scope of this invention.

The three rings 13 of the ring binder mechanism 1 are substantially similar and are each generally circular in shape (e.g., FIG. 1). As shown in FIGS. 1 and 2, the rings 13 each include two generally semi-circular ring members 23*a*, 23*b* formed from a conventional, cylindrical rod of a suitable material (e.g., steel). The ring members 23*a*, 23*b* include free ends 25*a*, 25*b*, respectively, formed to secure the ring members against transverse misalignment (relative to longitudinal axes of the ring members) when they are closed together (see, FIG. 1). The rings 13 could be D-shaped as is known in the art, or otherwise shaped within the scope of this invention. Ring binder mechanisms with ring members formed of different material or having different cross-sectional shapes, for example, oval shapes, do not depart from the scope of this invention.

As also shown in FIG. 2, the ring mechanism 1 includes two substantially identical hinge plates, designated generally at 27*a*, 27*b*, supporting the ring members 23*a*, 23*b*. respectively. The hinge plates 27*a*, 27*b* are each generally elongate, flat, and rectangular in shape and are each somewhat shorter in length than the housing 11. Four corresponding cutouts 29*a-d* are formed in each of the hinge plates 27*a*, 27*b* along an inner edge margin of the plate. A finger 31 extends longitudinally away from a first end of each of the hinge plates 27*a*, 27*b* (to the right in FIG. 2). The fingers 31 are each narrower in width than the respective hinge plates 27*a*, 27*b* and are positioned with their inner longitudinal edges generally aligned with the inner longitudinal edges of the plates. The purpose of the cutouts 29*a-d* and fingers 31 will be described hereinafter. The lever 15 and hinge plates 27*a*, 27*b* can broadly be referred to as an "actuation system."

Figure 3:
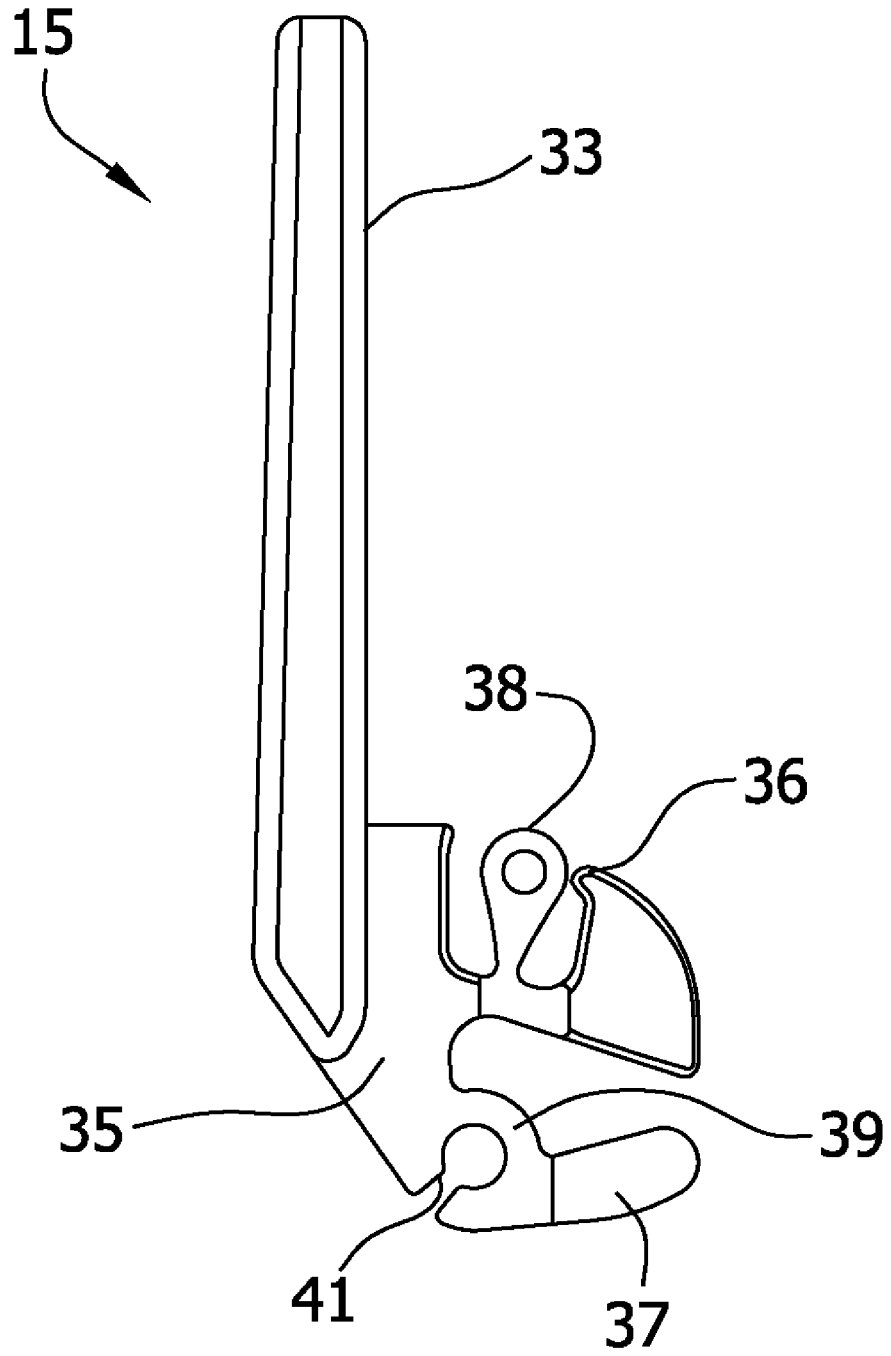
FIG. 3 is an enlarged side view of a lever of the mechanism.

Referring to FIGS. 2 and 3, the lever 15 includes a grip 33, a body 35 attached to the grip, and an upper lip 36 and lower lip 37 attached to the body. The grip 33 is somewhat broader than each of the body 35, upper lip 36, and lower lip 37 (FIG. 2) and facilitates grasping the lever 15 and applying force to move the lever. In the illustrated ring mechanism 1, the body 35 is formed as one piece with the grip 33 for substantially conjoint movement with the grip. The body 35 may be formed separate from the grip 33 and attached thereto without departing from the scope of the invention.

As shown in FIG. 3, a flexible connecting arm 38 ("first portion) is connected to the body 35 of the actuator 15 between the body and the upper lip 36 ("second portion"). The arm 38 is attached at its bottom end to the body 35 and projects upward from the body. The arm 38 is generally shaped as an inverted tear drop so that its bottom end connected to the body is narrower (when viewed from the side as in FIG. 3) than its free end. A connecting arm attached differently to a body of a lever is within the scope of the invention. In addition, a connecting arm shaped differently than illustrated is within the scope of the invention. The lower lip 37 ("third portion") of the lever 15 is attached to the body 35 by a flexible bridge 39 (or "living hinge") formed as one piece with the body and lower lip. A mechanism having a lever in which a bridge is formed separate from a body and/or lower lip for connecting the body and lower lip does not depart from the scope of the invention. The bridge 39 is generally arch-shaped and defines an open channel 41 between the lower lip 37 and body 35. The lower lip 37 extends away from the body 35 at the bridge 39 and channel 41 in general parallel alignment with the upper lip 36 and defines a C-shaped space between the body 35 and lower lip. It is envisioned that the lever 15 is formed from a resilient plastic material by, for example, a mold process. But the lever 15 may be formed from other materials or other processes within the scope of this invention. A ring mechanism having a lever shaped differently than illustrated and described herein does not depart from the scope of the invention.

Referring again to FIG. 2, the ring mechanism 1 includes an elongated travel bar designated generally at 45. The travel bar includes a mounting groove 47 at a first end (to the right in FIG. 2) and three locking elements (each designated generally at 49) along a bottom surface. The locking elements 49 are spaced apart longitudinally along the travel bar 45 with one locking element adjacent each longitudinal end of the travel bar, and one located toward a center of the travel bar. The travel bar 45 may have other shapes or greater or fewer than three locking elements 49 within the scope of this invention. The travel bar and locking elements may be broadly referred to as a "locking system."

Figure 7:
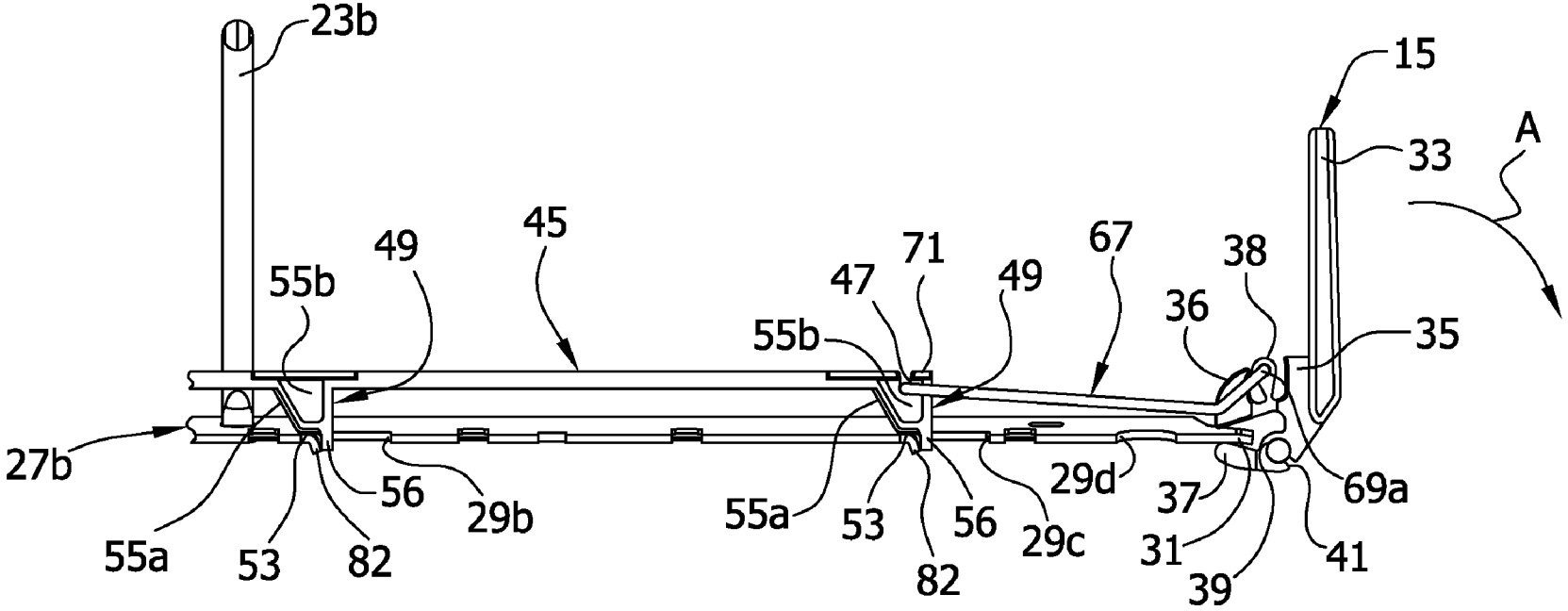
FIG. 7 is a fragmentary side elevation thereof with the housing and a hinge plate removed.

The locking elements 49 of the illustrated travel bar 45 are each substantially similar in shape. As shown in FIG. 7, each locking element 49 includes a narrow, flat bottom 53, an angled forward edge 55*a*, recessed lateral sides 55*b* (only one side is visible), and a rearward extension 56. In the illustrated embodiment, the locking elements 49 each have a generally wedge shape. The angled edges 55*a* of the locking elements 49 may engage the hinge plates 27*a*, 27*b* and assist in pivoting the hinge plates down. In the illustrated embodiment, the locking elements 49 are formed as one piece of material with the travel bar 45 by, for example, a mold process. But the locking elements 49 may be formed separately from the travel bar 45 and attached thereto without departing from the scope of the invention. Additionally, locking elements with different shapes, for example, block shapes (e.g., no angled edges or recessed sides), are within the scope of this invention.

Figure 4:
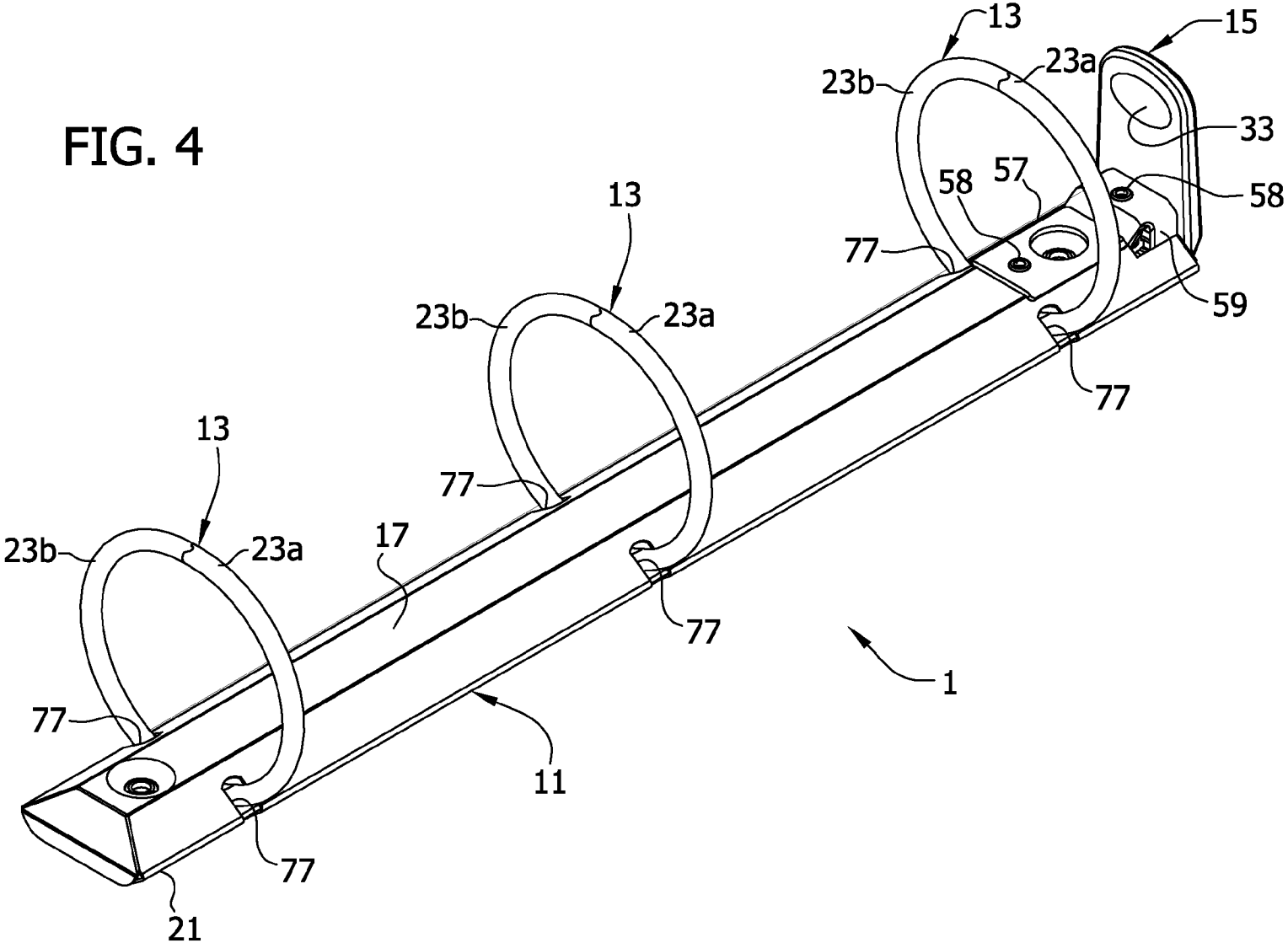
FIG. 4 is a top side perspective of the ring mechanism at a closed and locked position and with the lever in a first relaxed position.

The ring binder mechanism 1 in assembled form will now be described with reference to FIGS. 4-7 in which the mechanism is illustrated with the ring members 23*a*, 23*b* in the closed position and the lever 15 in an upright position. As shown in FIG. 4, the lever 15 pivotally mounts on the first, open end of the housing 11 by a lever mount 57 secured to the housing by rivets 58 (see also FIG. 2). Mounting arms 59 (only one is visible) of the mount 57 extend downward from the mount. A mounting opening 60 (FIG. 2) in each mounting arm 59 aligns with the channel 41 of the lower lip 37. A hinge pin 61 passes through the aligned openings 60 and channel 41 to pivotally mount the lever 15 on the housing 11. The mounting arms 59 are shown as being one piece with the lever mount 57, but they may be formed separately from the lever mount and attached thereto without departing from the scope of the invention. A lever mounted directly on a housing, for example a housing with mounting arms formed as part of the housing, is within the scope of the invention.

Figure 6:
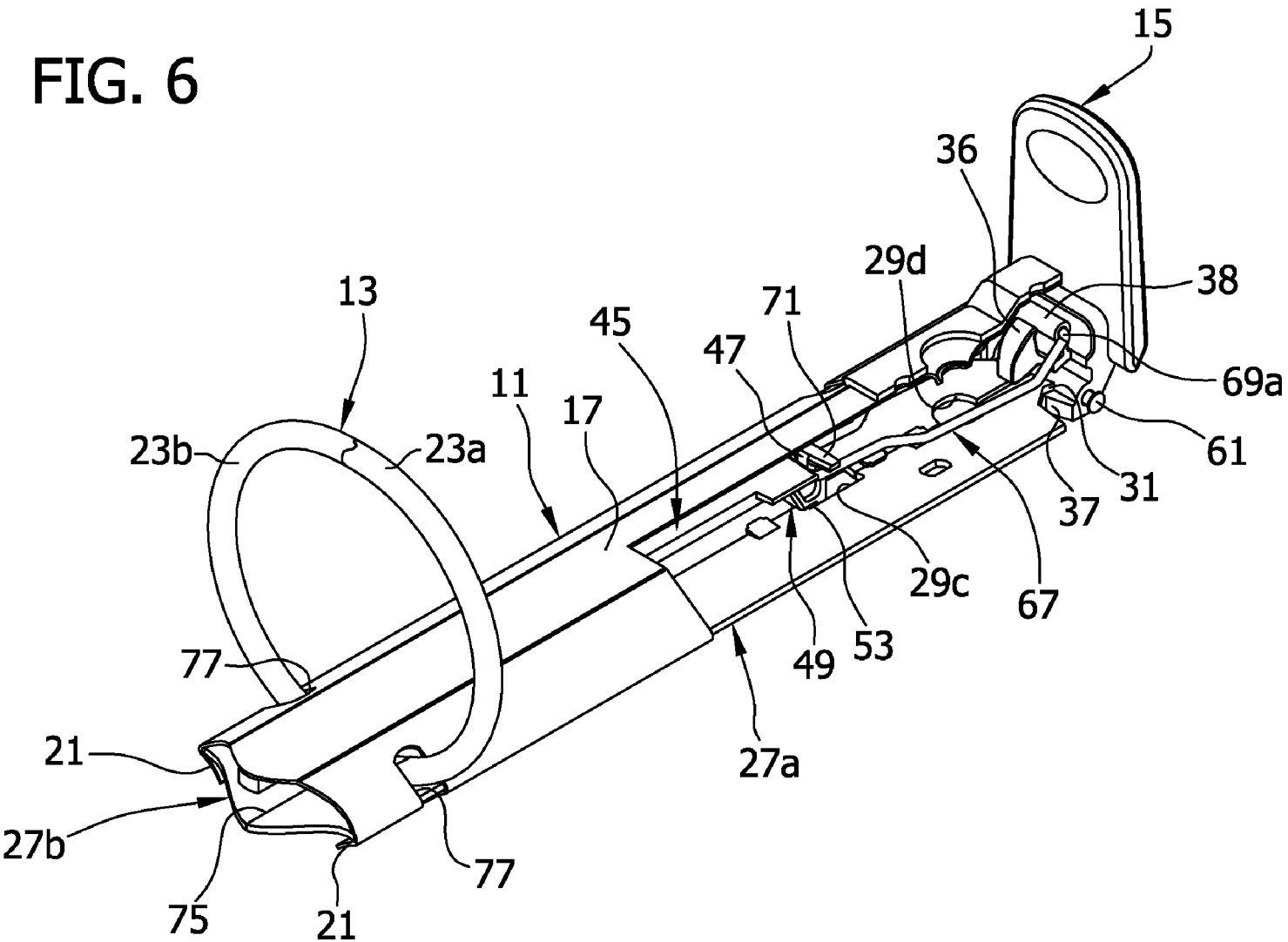
FIG. 6 is an enlarged fragmentary perspective of the ring mechanism of FIG. 4 with a portion of a housing broken away and with ring members removed to show internal construction.

As shown in FIG. 6, the travel bar 45 is disposed within the housing 11 behind the housing's plateau 17. It extends lengthwise of the housing 11, in generally parallel orientation with a longitudinal axis LA (see FIG. 2) of the housing, with the locking elements 49 extending toward the hinge plates 27*a*, 27*b*. Referring to FIGS. 6 and 7, the travel bar 45 is operatively connected to the lever 15 by an intermediate connector, designated generally at 67. In the illustrated embodiment, the intermediate connector 67 is a wire bent into an elongate, roughly rectangular form (see FIG. 2). The intermediate connector 67 may have other shapes or be formed from other material within the scope of this invention. A first end of the intermediate connector 67 is open and includes two free ends 69*a*, 69*b* (see FIG. 2) that fit within openings (only one is visible in the drawings) in the flexible connecting arm 38 of the lever 15 to form a pivoting connection. A second, closed end of the intermediate connector 67 is narrowed and can be resiliently deformed to fit around a tab 71 of the travel bar 45 and within the bar's mounting groove 47. The tab 71 prevents the intermediate connector 67 from inadvertently popping out of the groove 47 of the travel bar 45 and allows the connector to either push against the travel bar or pull on the travel bar. The intermediate connector 67 can pivot relative to the travel bar 45 within the groove 47 to accommodate the intermediate connector's vertical component of motion that occurs when the lever 15 pivots. A ring binder mechanism lacking an intermediate connector (e.g., in which a travel bar is pivotally connected directly to a lever) does not depart from the scope of this invention.

Figure 5:
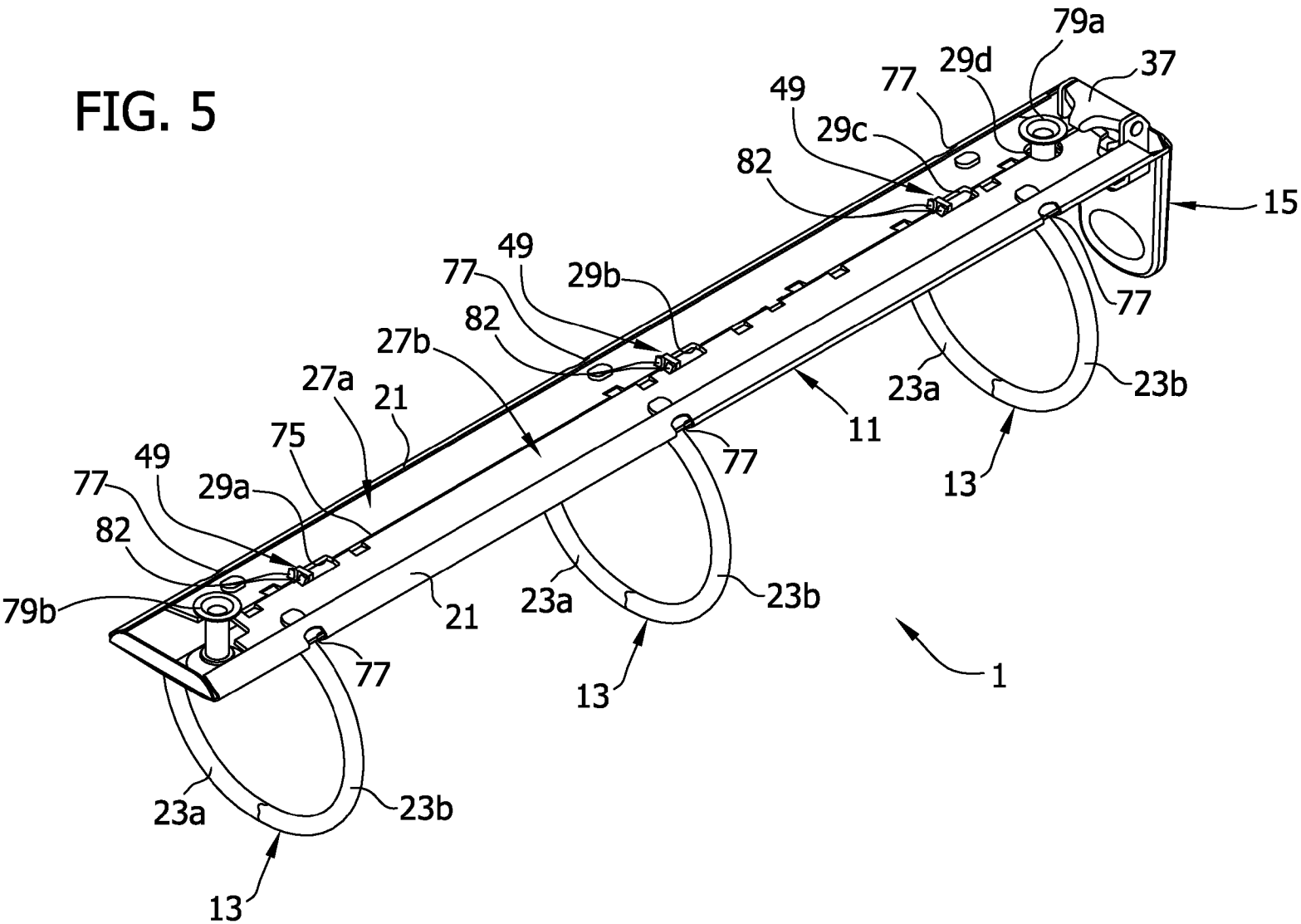
FIG. 5 is a bottom side perspective thereof.

As shown in FIGS. 5 and 6, the hinge plates 27*a*, 27*b* are interconnected in parallel arrangement along their inner longitudinal edge margins, forming a central hinge 75 having a pivot axis. This is done in a conventional manner known in the art. As will be described, the hinge plates 27*a*, 27*b* can pivot about the hinge 75 upward and downward. The four cutouts 29*a-d* in each of the two individual hinge plates 27*a*, 27*b* (FIG. 2) align to form four openings also designated 29*a-d* in the interconnected plates (FIG. 5). The housing 11 supports the interconnected hinge plates 27*a*, 27*b* within the housing below the travel bar 45. The outer longitudinal edge margins of the hinge plates 27*a*, 27*b* loosely fit behind the bent under rims 21 of the housing 11 for allowing them to move within the rims when the hinge plates pivot. As shown in FIGS. 6 and 7, the fingers 31 of the hinge plates 27*a*, 27*b* (only one hinge plate 27*a* is shown) extend into the C-shaped space of the lever 15 between the lower lip 37 and the upper lip 36 so that lower surfaces of the hinge plates are engageable by the lower lip and upper surfaces of the hinge plates 27*a*, 27*b* are engageable by the upper lip.

As shown in FIG. 2, the ring members 23*a*, 23*b* are each mounted on upper surfaces of respective ones of the hinge plates 27*a*, 27*b* in generally opposed fashion, with the free ends 25*a*, 25*b* facing. As shown in FIGS. 4-6, the ring members 23*a*, 23*b* extend through respective openings, each designated 77, along sides of the housing 11 so that the free ends 25*a*, 25*b* of the ring members can engage above the housing. The ring members 23*a*, 23*b* are rigidly connected to the hinge plates 27*a*, 27*b* as is known in the art and move with the hinge plates when they pivot. Although in the illustrated ring binder mechanism 1 both ring members 23*a*, 23*b* of each ring 13 are each mounted on one of the two hinge plates 27*a*, 27*b* and move with the pivoting movement of the hinge plates, a mechanism in which each ring has one movable ring member and one fixed ring member does not depart from the scope of this invention (e.g., a mechanism in which only one of the ring members of each ring is mounted on a hinge plate with the other ring member mounted, for example, on a housing).

As shown in FIG. 5, two mounting posts 79*a*, 79*b* (see also, FIG. 2) are secured to the illustrated ring mechanism 1 to mount the mechanism on, for example, the notebook 3 (e.g., FIG. 1) in any suitable manner. The posts 79*a*, 79*b* attach to the housing 11 at mounting post openings 81*a*, 81*b* (FIG. 2) of the plateau 17 located toward the longitudinal ends of the housing. A first mounting post 79*a* (toward the right in FIG. 5) extends through the intermediate connector 67 and through mounting post opening 29*d* of the interconnected hinge plates 27*a*, 27*b*.

Operation of the ring mechanism 1 will now be described with reference to FIGS. 4-13. As is known, the hinge plates 27*a*, 27*b* pivot downward and upward relative to the housing 11 and move the ring members 23*a*, 23*b* mounted thereon between a closed position (e.g., FIGS. 1 and 4-7) and an open position (e.g., FIGS. 9-11). The hinge plates 27*a*, 27*b* are wider than the housing 11 when in a co-planar position (180°), so as they pivot through the co-planar position, they deform the housing and create a small spring force in the housing. The housing spring force biases the hinge plates 27*a*, 27*b* to pivot away from the co-planar position, either downward or upward. The ring members 23*a*, 23*b* close when the hinge plates 27*a*, 27*b* pivot downward (i.e., the hinge 75 moves away from the housing 11 (e.g., FIG. 5)). The ring members 23*a*, 23*b* open when the hinge plates 27*a*, 27*b* pivot upward (i.e., the hinge 75 moves toward the housing 11 (e.g., FIG. 11)).

In FIGS. 4-7, the ring mechanism 1 is in a closed and locked position. The hinge plates 27*a*, 27*b* are hinged downward, away from housing 11, so that the ring members 23*a*, 23*b* of each ring 13 are together in a continuous, circular loop, capable of retaining loose-leaf pages. The lever 15 is vertical relative to the housing 11 and in a first relaxed position (the lever is shown in this position in FIG. 3 also) with the lower lip 37 of the lever engaging the lower surfaces of the hinge plates 27*a*, 27*b*. The flexible connecting arm 38 is positioned adjacent the upper lip 36 (see FIG. 7). The locking elements 49 of the travel bar 45 are positioned adjacent respective locking element openings 29*a-c* and above the hinge plates 27*a*, 27*b* generally aligned with the hinge 75. The locking elements 49 are substantially out of registration with the openings 29*a-c*. The flat bottom surfaces 53 rest on an upper surface of the plates 27*a*, 27*b* and the rearward extensions 56 extend through each respective opening 29*a-c* adjacent forward, downturned tabs 82 of the plates. Together, the travel bar 45 and locking elements 49 oppose any force tending to pivot the hinge plates 27*a*, 27*b* upward to open the ring members 23*a*, 23*b* (i.e., they lock the ring members closed).

Figure 8:
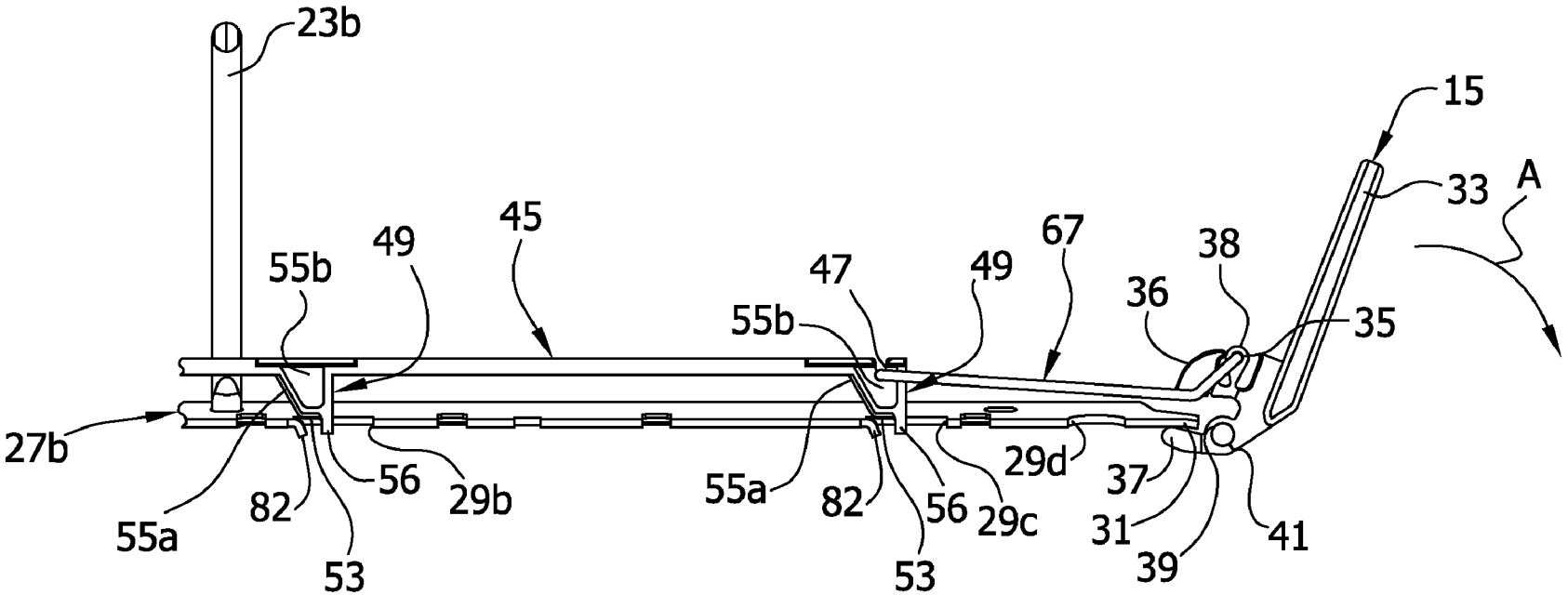
FIG. 8 is similar to FIG. 7 but with the ring mechanism at a closed and unlocked position and with the lever in a first deformed position.

To unlock the ring mechanism 1 and open the ring members 23*a*, 23*b*, an operator applies force to the grip 33 of the lever 15 and pivots it clockwise (arrow A as viewed in FIGS. 7 and 8). As shown in FIG. 8, the grip 33, body 35, upper lip 36, and connecting arm 38 of the lever 15 move relative to the lower lip 37, which is held stationery by the hinge plates 27*a*, 27*b* under the spring force of the housing 11. The intermediate connector 67 is simultaneously pulled by the lever connecting arm 38 and upper lip 36 pushing against the arm and transfers the pivoting movement of the lever 15 around the mounting post 79*a* (not shown) to linear movement of the travel bar 45. The travel bar slides toward the lever 15 and moves the locking elements 49 into registration over the respective locking element openings 29*a-c* of the hinge plates 27*a*, 27*b*. The bridge 39 between the lever body 35 and lever lower lip 37 flexes and tensions as the open channel 41 closes and the body 35 moves into engagement with the lower lip 37 (FIG. 8). The lever 15 is in a first deformed position. At this instant in the opening movement, if the lever 15 is released before the hinge plates 27*a*, 27*b* pivot upward through their co-planar position (i.e., before the ring members 23*a*, 23*b* open), the tension in the bridge 39 will automatically recoil (and rotatably push) the grip 33 and body 35 back to the vertical position, moving the travel bar 45 and locking elements 49 to the locked position.

Figure 9:
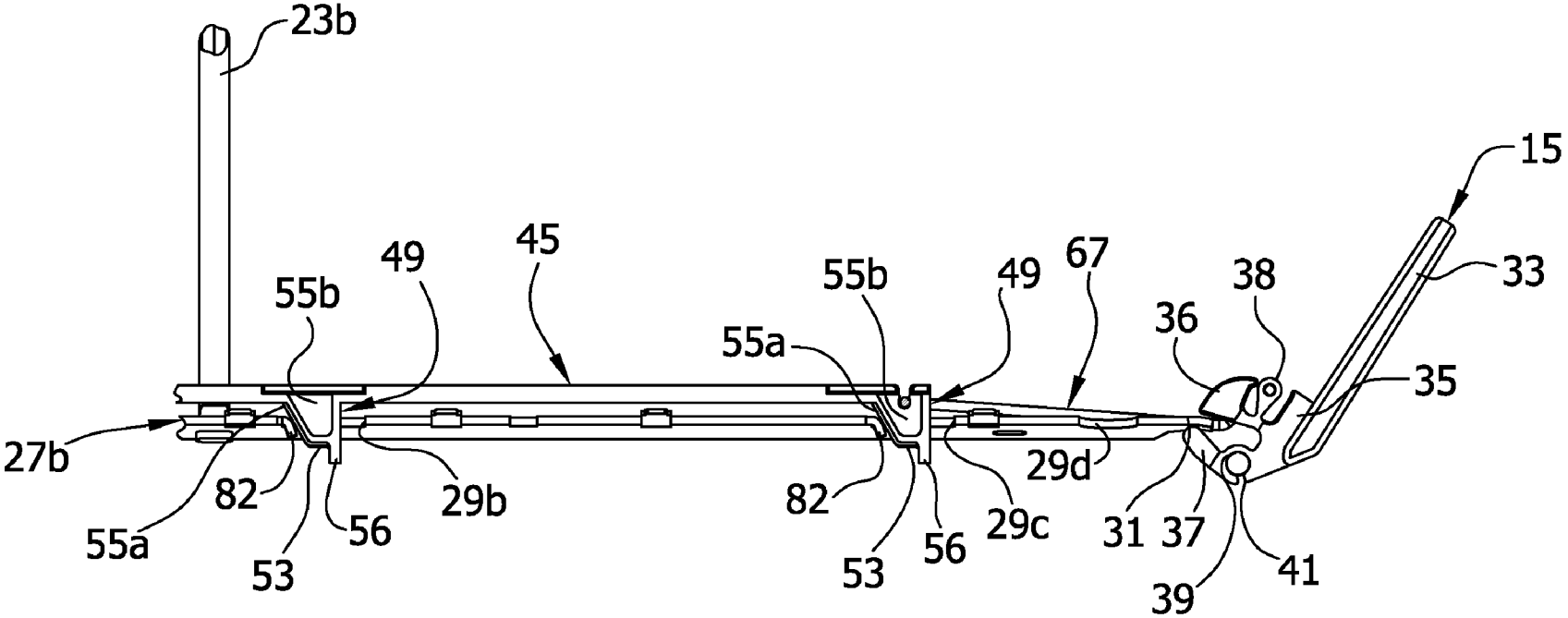
FIG. 9 is similar to FIG. 8 but with a foreground part of an intermediate connector broken away, the ring mechanism at an open position and the lever at a second relaxed position.
Figure 10:
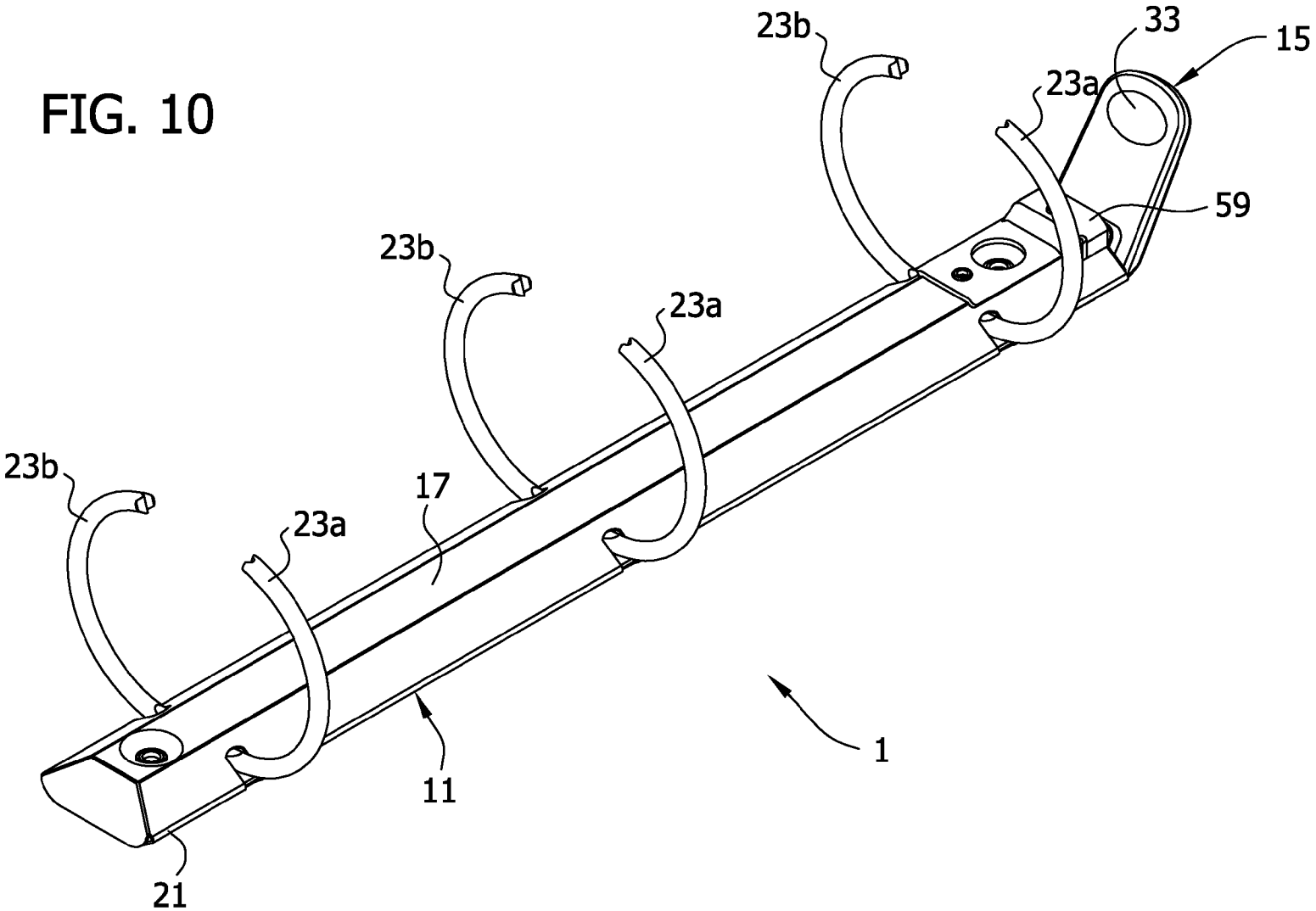
FIG. 10 is a top side perspective of the ring mechanism at the open position.
Figure 11:
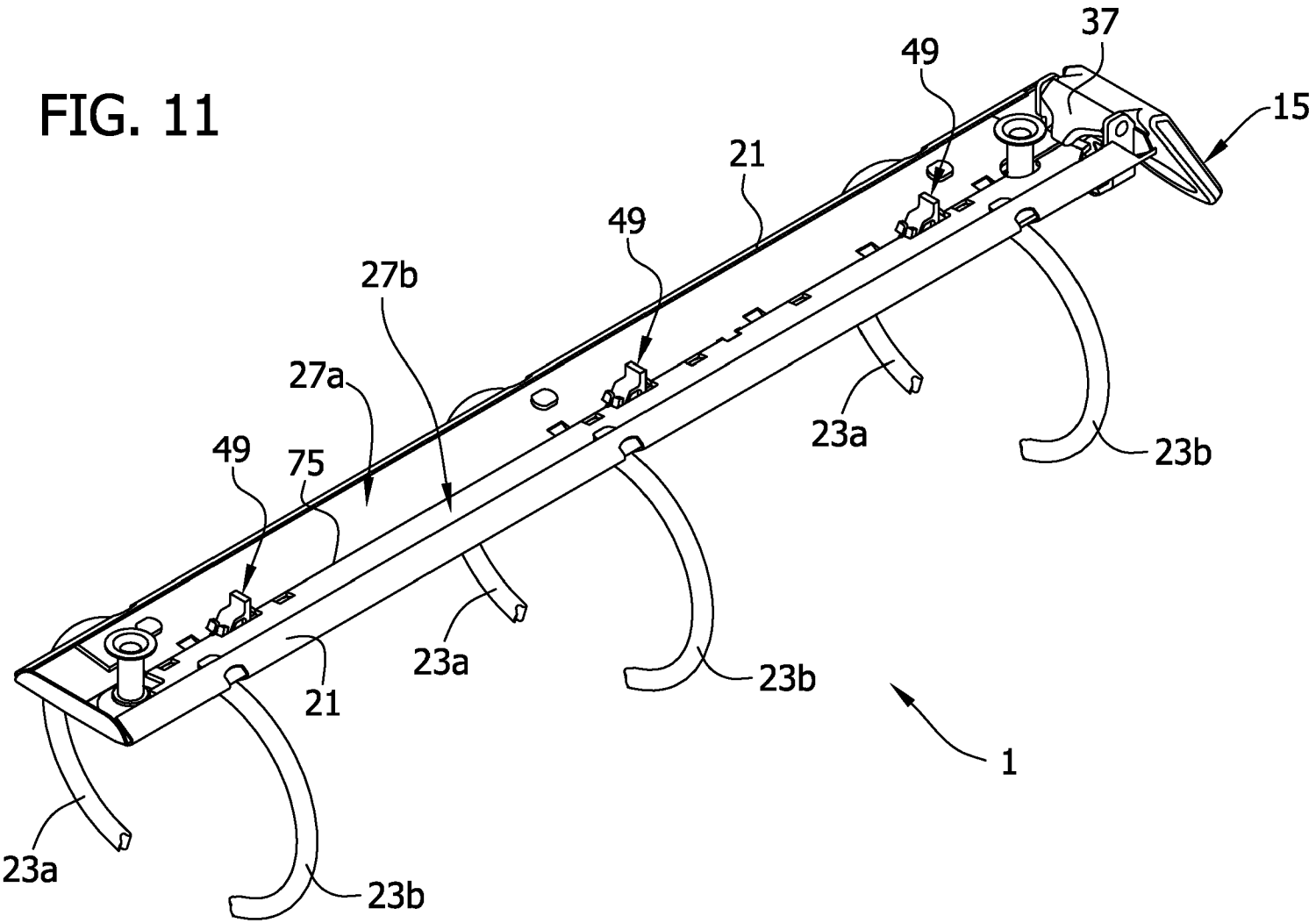
FIG. 11 is a bottom side perspective thereof.

The lever channel 41, now closed, no longer shields the lower lip 37 from the pivoting movement of the grip 33, body 35, upper lip 36, and connecting arm. Continued opening movement of the lever 15 causes the body 35 to conjointly pivot the lower lip 37. The lower lip 37 causes the interconnected hinge plates 27*a*, 27*b* to pivot upward over the locking elements 49 at the locking element openings 29*a-c* and relative to the mounting post 79*a* at the mounting post opening 29*d*. Once the hinge plates 27*a*, 27*b* pass just through the co-planar position, the housing spring force pushes them upward, opening the ring members 23*a*, 23*b* (FIGS. 9-11). The lever 15 can be released. The tension in the bridge 39 recoils (and pushes) the grip 33, body 35, upper lip 36, and connecting arm 38 away from the lower lip 37, which is held stationary against the lower surfaces of the hinge plates 27*a*, 27*b*. As the channel 41 opens, the travel bar 45 moves slightly away from the lever 15. The lever is again relaxed, in a second relaxed position substantially identical to the first relaxed position (e.g., FIG. 3), and the locking elements 49 are at rest within the respective hinge plate openings 29*a-c* free of any forces tending to move them relative to the housing 11.

Figure 12:
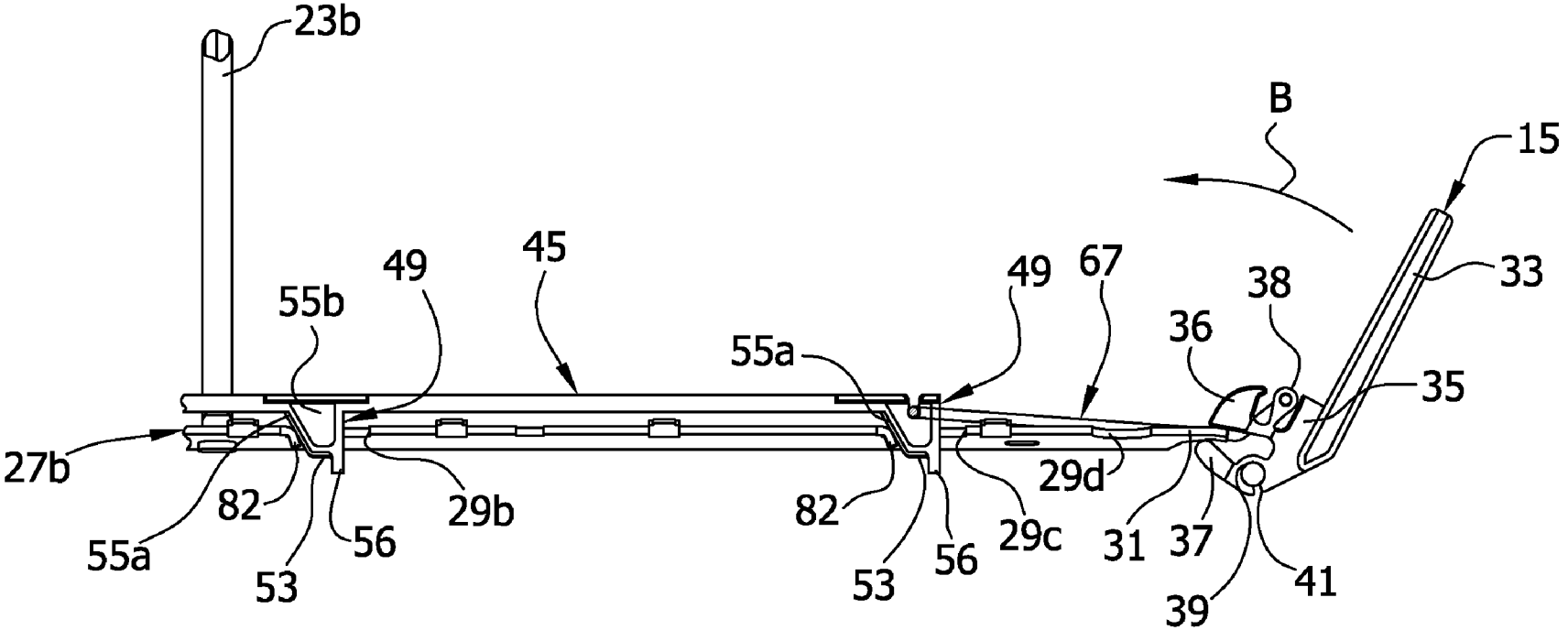
FIG. 12 is similar to FIG. 9 but with the ring mechanism at the open position and with the lever in a second deformed position pivoting to move the mechanism to the closed and locked position.
Figure 13:
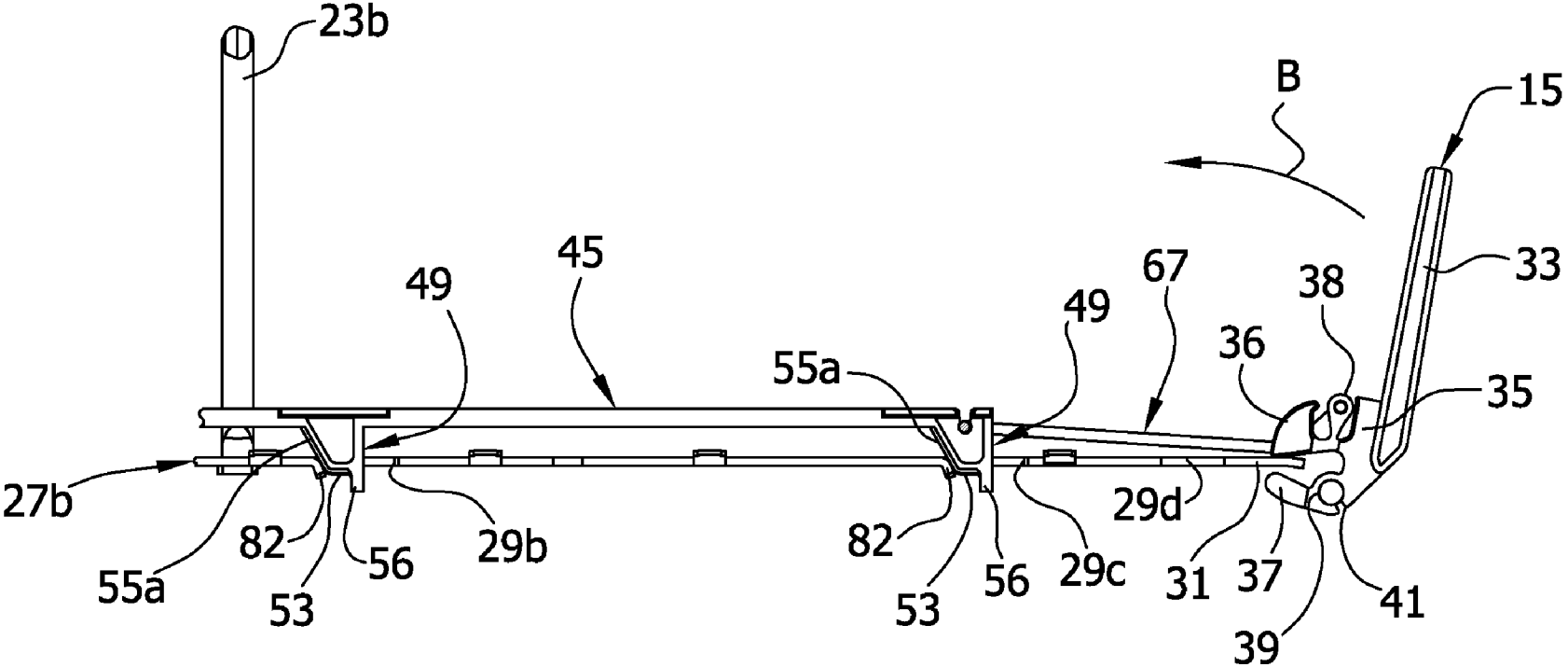
FIG. 13 is the side view of FIG. 12 illustrating further pivoting movement of the lever to move the mechanism to the closed and locked position and with the lever still deformed.

To close the ring members 23*a*, 23*b* and return the mechanism 1 to the locked position, an operator can pivot the lever 15 upward and inward as shown in FIG. 12 (counter-clockwise as shown by arrow B in FIG. 12). The upper lip 36 of the lever 15 begins pushing downward on the hinge plates 27*a*, 27*b*, but the spring force of the housing 11 resists the initial hinge plate movement. The connecting arm 38 may initially move with the upper lip 36 to push the intermediate connector 67 and travel bar 45 forward and seat the forward edges 55*a* of the locking elements 49 against the tabs 82 of the hinge plates 27*a*, 27*b* (if they are not already seated). As the lever 15 continues to pivot, the seated locking elements 49 resist further movement of the connecting arm 38 via the connection of the travel bar 45 to the connecting arm by the intermediate connector 67. At this point, the upper lip 36, grip 33, body 35, and lower lip 37 move relative to the connecting arm 38 as the lever 15 continues to be pivoted. This relative movement causes tension in the connecting arm 38, and the connecting arm flexes (or bends) away from the upper lip 36 toward the lever body 35. The lever 15 is now in a second deformed position. At this instant in the closing movement, if the lever 15 is released before the hinge plates 27*a*, 27*b* pivot downward through their co-planar position (i.e., before the ring members 23*a*, 23*b* close), the tension in the connecting arm 38 will automatically recoil (and push) the lever 15 back to its second relaxed position.

Continued closing movement of the lever 15 causes the upper lip 36 to pivot the interconnected hinge plates 27*a*, 27*b* downward. Once the hinge plates 27*a*, 27*b* pass just through the co-planar position, the housing 11 spring force pushes them downward, closing the ring members 23*a*, 23*b*. Pivoting the hinge plates 27*a*, 27*b* slightly downward while allowing the travel bar 45 and locking elements 49 to remain stationary allows the locking elements to subsequently move more easily relative to the hinge plates and avoids jamming the lever 15. The connecting arm 38 flexes until it engages the body 35, as illustrated in FIG. 12. Thereafter, the connecting arm 38 moves conjointly with the body 35, upper lip 36 and lower lip 37. The connecting arm 38 pushes the intermediate connector 67, travel bar 45, and locking elements 49 back to their locked position with the locking elements behind the hinge plates 27*a*, 27*b*. Once the locking elements 49 are out of the openings 29*a*-29*c*, the tension in the connecting arm 38 recoils and moves the arm back toward the upper lip 36, further pushing the intermediate connector 67, travel bar 45, and locking elements 49 to the locked position. The connecting arm 38 returns to its position adjacent the upper lip 36. The lever is again relaxed in the first relaxed position, and the locking elements 49 are at rest behind the hinge plates 27*a*, 27*b*, blocking pivoting motion and again free of any forces tending to move them relative to the housing 11.

In the illustrated mechanism 1, the ring members 23*a*, 23*b* can also be closed by manually pushing the free ends 25*a*, 25*b* of the ring members together.

It should be apparent that the flexibility of the lever bridge 39 allows the grip 33 and body 35 of the lever 15 to move relative to the lower lip 37 during opening operation. In addition, the flexibility of the connecting arm 38 allows the upper lip 36, grip 33, body 35, and lower lip 37 to move relative to the travel bar 45 and locking elements 49 during closing operation. These lost motion features allow the lever 15 to move between the relaxed position (FIGS. 3-7 and 9-11) and a deformed (broadly, "reconfigured") position (FIGS. 8, 9, 12, and 13). The deformed position of the lever 15 is an unstable, intermediate position in which either the bridge 39 or connecting arm 38 is tensioned to always move the grip 33, body 35, lower lip 37, and upper lip 36 to the relaxed position (i.e., reconfigure the lever).

When the lever 15 pivots to open the ring members 23*a*, 23*b*, the travel bar 45 and locking elements 49 move immediately and prior to the lower lip 37 pivoting the hinge plates 27*a*, 27*b* upward. This lost motion caused by the open channel 41 allows the locking elements 49 to move into registration with the locking element openings 29*a-c* of the hinge plates 27*a*, 27*b* before the hinge plates pivot. They do not interfere with the desirable pivoting movement of the hinge plates 27*a*, 27*b*. After the locking elements 49 move into registration with the respective openings 29*a-c*, the channel 41 closes and the grip 33, body 35, upper lip 36, and lower lip 37 conjointly pivot to move the hinge plates 27*a*, 27*b* upward.

In addition when the ring members 23*a*, 23*b* are open and the lever 15 is relaxed, the locking elements 49 and travel bar 45 are free of forces tending to move them to the locked position. Thus, there is no tendency for the open ring members 23*a*, 23*b* to inadvertently close under the influence of the lever 15, locking elements 49, or travel bar 45 as an operator loads or removes pages from the ring members 23*a*, 23*b*.

Similarly when the ring members 23*a*, 23*b* are moved to the closed position, the flexible connecting arm 38 allows the upper lip 36 to pivot the hinge plates 27*a*, 27*b* downward before pushing the travel bar 45 and locking elements 49 to the locked position. Thus, movement of the travel bar 45 and locking elements 49 are delayed from movement of the lever 15 and hinge plates 27*a*, 27*b* and do not interfere with the pivoting movement of the hinge plates 27*a*, 27*b*. In addition, the tension produced in the connecting arm 38 during closing operation ensures that the locking elements 49 are moved fully to the locked position after the ring members 23*a*, 23*b* close through the recoil action of the connecting arm 38 without the use of additional spring features.

In addition, continuous engagement between the lever lower lip 37 and the lower surfaces of the hinge plates 27*a*, 27*b* during closing operation ensures that the body 35 and grip 33 of the lever 15 move fully to their vertical position when the hinge plates 27*a*, 27*b* are pivoted downward (and the ring members 23*a*, 23*b* are closed).

Thus, the ring binder mechanism 1 effectively retains loose-leaf pages when ring members 23*a*, 23*b* are closed, and readily prevents the closed ring members 23*a*, 23*b* from unintentionally opening. The lever 15 positions the travel bar 45 and its locking elements 49 in the locked position when the ring members 23*a*, 23*b* close, eliminating the need to manually move the lever 15 to positively lock the mechanism 1. The ring mechanism 1 incorporating the locking lever 15 requires no additional biasing components (e.g., springs) to perform the locking operation, and requires no specially formed parts to accommodate such biasing components.

Components of ring binder mechanisms of the embodiments described and illustrated herein are made of a suitable rigid material, such as a metal (e.g. steel). But mechanisms having components made of a nonmetallic material, specifically including a plastic, do not depart from the scope of this invention.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "forward" and "rearward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for holding loose-leaf pages, the mechanism comprising:

a housing;

rings for holding the loose-leaf pages, each ring including a first ring member and a second ring member, the first ring members being movable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

an actuation system operable to move the ring members between the closed and open positions, the actuation system comprising first and second hinge plates supported by the housing for pivoting motion relative to the housing, said first ring members being mounted on the first hinge plate and moveable with the pivoting motion of the first hinge plate between the closed and open positions, and an actuator mounted on the housing for movement relative to the housing to cause the pivoting motion of the hinge plates, the actuator being moveable between a first position in which the ring members are in the closed position and a second position in which the ring members are in the open position;

a locking system moveable by the actuator between a locked position in which the ring members are held in the closed position and an unlocked position in which the ring members can move from the closed position to the open position;

wherein the actuation system is adapted to deform during movement of the actuator from said second position to said first position in response to a force exerted on the locking system by at least one of the hinge plates resisting movement of the locking system toward the locked position and the actuator is arranged relative to the locking system to pivot the hinge plates toward the closed position while the locking system is held stationary relative to the housing by said at least one hinge plate to delay movement of the locking system from the pivoting movement of the hinge plates.

2. A ring mechanism as set forth in claim 1 wherein the actuator is adapted to deform in response to said force exerted on the locking system during movement of the actuator from said second position to said first position.

3. A ring mechanism as set forth in claim 2 wherein the actuator comprises a first portion and a body, the first portion being connected to the body and flexible relative to the body.

4. A ring mechanism as set forth in claim 3 wherein the first portion and body are formed as one piece.

5. A ring mechanism as set forth in claim 3 wherein the first portion flexes relative to the body when the actuator moves from the second position to the first position.

6. A ring mechanism as set forth in claim 5 wherein the actuator further comprises a second portion, the first portion being deformable relative to the second portion when the actuator moves from the second position to the first position.

7. A ring mechanism as set forth in claim 6 wherein the first and second portions are formed as one piece.

8. A ring mechanism as set forth in claim 6 wherein the locking system comprises a travel bar connected to the actuator and moveable by the actuator between the locked and unlocked positions.

9. A ring mechanism as set forth in claim 8 wherein the travel bar affects the pivoting motion of the hinge plates.

10. A ring mechanism as set forth in claim 8 wherein the actuation system comprises an intermediate connector connecting the travel bar to the actuator, the intermediate connector connecting to the actuator at said first portion.

11. A ring mechanism as set forth in claim 10 wherein the travel bar comprises a groove and a tab, the groove receiving the intermediate connector on the travel bar and the tab holding the connector on the travel bar.

12. A ring mechanism as set forth in claim 10 wherein the travel bar comprises a locking element, the travel bar and locking element blocking the pivoting motion of the hinge plates when the ring members are in the closed position.

13. A ring mechanism as set forth in claim 12 wherein at least one of the hinge plates comprises an opening for receiving the locking element through the hinge plates when the ring members are in the open position, the locking element engaging the at least one hinge plate at said opening when the actuator moves from the second position to the first position causing the first portion of the actuator to move relative to the body.

14. A ring mechanism as set forth in claim 6 wherein the actuator further comprises a third portion and a living hinge connecting the third portion to the body of the actuator.

15. A ring mechanism as set forth in claim 1 wherein the locking system comprises a locking element movable by the actuator between the locked position blocking the pivoting motion of the hinge plates and the unlocked position allowing the pivoting motion of the hinge plates, the locking element in the locked position being free of forces tending to move the locking element from the locked position toward the unlocked position and in the unlocked position being free of forces tending to move the locking element from the unlocked position toward the locked position.

16. A ring mechanism as set forth in claim 1 wherein the actuator comprises a lever.

17. A ring mechanism as set forth in claim 1 in combination with a cover, the ring mechanism being mounted on the cover, the cover being hinged for movement to selectively cover and expose loose-leaf pages when retained on the ring mechanism.

18. A ring mechanism as set forth in claim 1 wherein the locking system comprises a travel bar moveable by the actuator between the locked and unlocked positions and the actuation system further comprises an intermediate connector connecting the travel bar to the actuator.

19. A ring mechanism for retaining loose-leaf pages, the mechanism comprising:

a housing;

hinge plates supported by the housing for pivoting motion relative to the housing;

rings for holding the loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

an actuator mounted on the housing for movement relative to the housing for causing the pivoting motion of the hinge plates, the actuator comprising a flexible first portion and a body;

a locking element for releasably locking the closed ring members in a locked position and releasing the closed ring members to move to the open position in an unlocked position;

an intermediate connector connecting the locking element and the first portion of the actuator for conjoint translational movement with the first portion so that movement of said first portion produces translational movement of the locking element;

the first portion of the actuator being adapted to flex relative to the body of the actuator during operation of the actuator to close the ring members in response to a force exerted on the locking element by at least one of the hinge plates resisting movement of the locking element toward the locked position;

the actuator being operable to pivot the hinge plates toward the closed position while the locking element is held stationary relative to the housing by said at least one hinge plate to offset movement of the locking element from the pivoting movement of the hinge plates.

20. A ring mechanism as set forth in claim 19 further comprising a travel bar movable relative to the hinge plates and including the locking element for releasably locking the closed ring members in the locked position and releasing the ring members to move to the open position in the unlocked position, the intermediate connector engaging the travel bar.

21. A ring mechanism for holding loose-leaf pages, the mechanism comprising:

a housing;

rings for holding the loose-leaf pages, each ring including a first ring member and a second ring member, the first ring members being movable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator moveable relative to the housing to cause the pivoting motion of the hinge plates, the actuator being moveable between a first position in which the ring members are in the closed position and a second position in which the ring members are in the open position, the actuator comprising a body, an upper lip connected to the body and positioned to pivot the hinge plates and move the rings to the closed position when the actuator moves from the second position to the first position, a lower lip connected to the body by a living hinge and positioned to pivot the hinge plates and move the rings to the open position when the actuator moves from the first position to the second position;

a travel bar comprising a locking element, the travel bar being moveable by the actuator between a locked position in which the ring members are held in the closed position by the locking element and an unlocked position in which the ring members can move from the closed position to the open position;

wherein the actuator further comprises a flexible arm connected to the body, the flexible arm being adapted to push the travel bar toward its locked position when the actuator moves from the second position to the first position, the flexible arm being adapted to deform during movement of the actuator from the second position to the first position to offset movement of the travel bar from the pivoting movement of the hinge plates.

22. A ring mechanism as set forth in claim 21 wherein the flexible arm includes a first end attached to the actuator and a second end operatively engaged with the travel bar.

23. A ring mechanism as set forth in claim 22 further comprising an intermediate connector engageable with the second end of the flexible arm and connected to the travel bar.

24. A ring mechanism as set forth in claim 21 wherein the actuator includes a recess and the flexible arm is disposed generally in the recess.

25. A ring mechanism as set forth in claim 21 wherein the living hinge is adapted to deform when the actuator is moved from the first position to the second position to delay pivoting movement of the hinge plates until after the travel bar has been moved out of the locked position.

26. A ring mechanism as set forth in claim 21 wherein the body, upper lip, lower lip, and flexible arm are formed as one piece.

27. A ring mechanism as set forth in claim 26 wherein the actuator is made of a plastic material.

28. A ring mechanism as set forth in claim 21 wherein the flexible arm has an inverted tear drop shape.

* * * * *